US010525461B2

(12) United States Patent
Mulakkapurath Narayanan et al.

(10) Patent No.: US 10,525,461 B2
(45) Date of Patent: Jan. 7, 2020

(54) CARTRIDGE FOR PURIFICATION OF BIOLOGICAL SAMPLES

(71) Applicant: BIGTEC PRIVATE LIMITED, Rajajinagar, Bangalore, Karnataka (IN)

(72) Inventors: Manoj Mulakkapurath Narayanan, Bangalore (IN); Chandrasekhar Bhaskaran Nair, Bangalore (IN)

(73) Assignee: Bigtec Private Limited, Bangalore (IN)

( * ) Notice: Subject to any disclaimer, the term of this patent is extended or adjusted under 35 U.S.C. 154(b) by 0 days.

(21) Appl. No.: 15/251,671

(22) Filed: Aug. 30, 2016

(65) Prior Publication Data

US 2018/0057809 A1 Mar. 1, 2018

(51) Int. Cl.
*B01L 3/00* (2006.01)

(52) U.S. Cl.
CPC ..... *B01L 3/502* (2013.01); *B01L 2200/0631* (2013.01); *B01L 2300/087* (2013.01); *B01L 2400/06* (2013.01)

(58) Field of Classification Search
CPC .. C12N 15/1006; G01N 1/405; C12Q 1/6806; B01L 3/502; B01L 2400/06; B01L 2200/0631; B01L 2300/087
See application file for complete search history.

(56) References Cited

U.S. PATENT DOCUMENTS

| | | | | |
|---|---|---|---|---|
| 8,394,642 | B2 * | 3/2013 | Jovanovich | G01N 27/745 422/50 |
| 2004/0086870 | A1 * | 5/2004 | Tyvoll | B01L 3/502715 435/6.19 |
| 2004/0126783 | A1 * | 7/2004 | Bortolin | B01L 3/502 435/6.12 |
| 2011/0100101 | A1 * | 5/2011 | Zenhausern | G01N 21/645 73/64.56 |
| 2012/0149603 | A1 * | 6/2012 | Cooney | B01L 3/5025 506/39 |

OTHER PUBLICATIONS

Hosokawa et al. (J Micromech. Microeng. 10 (2000) 415-420). (Year: 2000).*

* cited by examiner

*Primary Examiner* — Sally A Merkling
(74) *Attorney, Agent, or Firm* — Keller Jolley Preece

(57) ABSTRACT

The present disclosure provides a cartridge for purifying biological samples. The cartridge comprises a first chamber configured to receive and hold biological samples, and at least one second chamber configured to receive and hold a reagent solution. A first fluid flow control valve is fluidly connected to outlet ports of the first chamber and the at least one second chamber. Also, the first fluid flow control valve is fluidly connected to a matrix chamber and is configured to selectively route biological samples and reagent solution into the matrix chamber for purifying the biological samples. A binding matrix is configured in the matrix chamber for capturing the nucleic acids from the biological samples and the reagent solution. Further, a elute collection chamber is fluidly connected to the matrix chamber, wherein the elute collection chamber is configured to receive and hold purified biological sample from the matrix chamber.

12 Claims, 5 Drawing Sheets

CARTRIDGE FOR PURIFICATION OF BIOLOGICAL SAMPLES

TECHNICAL FIELD

The present disclosure generally relates to a field of bio-medical engineering. Particularly, but not exclusively the present disclosure relates to a device for purifying biological samples. Further, embodiments of the present disclosure disclose a cartridge which can be employed in the device for purifying the biological samples.

BACKGROUND OF THE DISCLOSURE

Isolation of biological molecules, such as DNA, RNA, proteins and other cellular components from biological samples such as blood, sputum, serum . . . etc., and their subsequent analysis is a fundamental part of molecular biology and biochemistry. Particularly, analysis of nucleic acids is used to identify specific organisms or specific cells in the biological samples, especially in field of medical diagnostics. The biological samples will be collected from the subjects, and are exposed to analysis for detection of organisms to identify various contagious diseases such as Tuberculosis (TB), Chikungunya . . . etc. Thus, purity, yield and quality of nucleic acids obtained from the sample collected from the subject have a critical effect on the analysis of the organisms to identify the diseases.

Generally, process and techniques for obtaining nucleic acids with adequate purity, yield and quality from clinical specimens involve processing the biological samples obtained from the subject in multiple steps. The process also involves use of skilled operators or manpower for operating the equipment involved in the process. Moreover, another major requirement is that the nucleic acids obtained from these processes must be compatible for undergoing various reactions including but not limiting to Polymerase chain reaction (PCR) test. Thus, these stringent requirements render the process tedious, time consuming and expensive.

Conventionally, processing of biological samples for the detection of Tuberculosis (TB) and other such infectious diseases involve culture testing and smear testing. Culture testing for the detection of Tuberculosis (TB) and other such infections, is time consuming (several weeks) and the processes required for such tests require specialized labs having controlled environmental conditions and bio-safety settings. However, this type of culture testing used in the detection of Tuberculosis (TB) and other such infections is not available to common population or people who are residing in remote locations.

Another conventional process of detection of Tuberculosis (TB) and other such infections from the sputum sample is by means of smear testing. However, though the smear testing is the most common test used for the detection of Tuberculosis (TB) and other such infections, it has its own set of disadvantages such as low sensitivity, and high dependency on the skill of operator, which is the factor for inconsistency in these tests.

Also, the tests which are carried out conventionally are expensive and require specific temperature controlled environment with uninterrupted power supply. Moreover, these kinds of tests were not available to the general population and equipment set ups have to be erected in specialized labs which are not economical.

To mitigate some of the problems stated above, few cartridge type systems have been developed in recent past, and are employed for processing the biological samples.

Such, cartridge type systems employ robotic assemblies for controlling the processes involved in analysis of the biological samples. The robots are generally programmed with specific co-ordinates for processing and analysing a particular biological sample. Thus any variation in the robotic co-ordinates while transporting the system, will affect purification of the biological sample. Further, such cartridges are not only used for purification, but also used for amplification which renders construction of the cartridges complex and expensive.

In addition, the conventional cartridge based systems utilise specific transducers such as ultrasonic agitators for separating the components required for analysis and detection. These systems are also needed to be subjected to certain conditions and limitations, such as requirement of a controlled environment for their operation, constant power supply and also has associated high costs. Furthermore, conventional systems dispose the waste fluids to the environment after purifying the biological sample, thereby rendering these methods hazardous and unhygienic.

In the light of the foregoing discussion, there is a need for an improved cartridge to overcome one or more limitations stated above.

SUMMARY OF THE DISCLOSURE

In one non-limiting embodiment of the present disclosure, a cartridge for purifying biological samples is provided. The cartridge comprises a first chamber configured to receive and hold biological samples, and at least one second chamber configured to receive and hold a reagent solution. A first fluid flow control valve is fluidly connected to outlet ports of the first chamber and the at least one second chamber. Also, the first fluid flow control valve is fluidly connected to a matrix chamber and is configured to selectively route biological samples and reagent solution into the matrix chamber for purifying the biological samples. A binding matrix is configured in the matrix chamber for capturing nucleic acids from the biological samples. Further, an elute collection chamber is fluidly connected to the matrix chamber, wherein the elute collection chamber is configured to receive and hold purified nucleic acids from the matrix chamber.

In an embodiment, the biological samples are routed into the matrix chamber as a first step.

In an embodiment, the reagent solutions are routed into the matrix chamber as a second step.

In an embodiment, a waste collection chamber is configured in the cartridge, which is fluidly connected to the matrix chamber, to receive waste fluids from the matrix chamber. The elute collection chamber includes an absorbent material to absorb the waste fluids received from the matrix chamber.

In an embodiment, the cartridge comprises a second fluid flow control valve fluidly connects the matrix chamber to the elute collection chamber and the waste collection chamber. The second fluid flow control valve is configured to route the purified sample into the elute collection chamber. The second fluid flow control valve is also configured to route waste fluids from the matrix chamber into the waste collection chamber.

In an embodiment, the reagent solution is routed into the matrix chamber (6) after routing the biological samples. In another embodiment, the at least one second chamber receives the reagent solutions through a pump.

In an embodiment, the matrix chamber is configured to receive heat from an external heating source to separate the nucleic acids captured in the binding matrix.

In an embodiment, the first fluid flow control valve and the second fluid flow control valves are three way directional control valves.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which.

Figure 1:
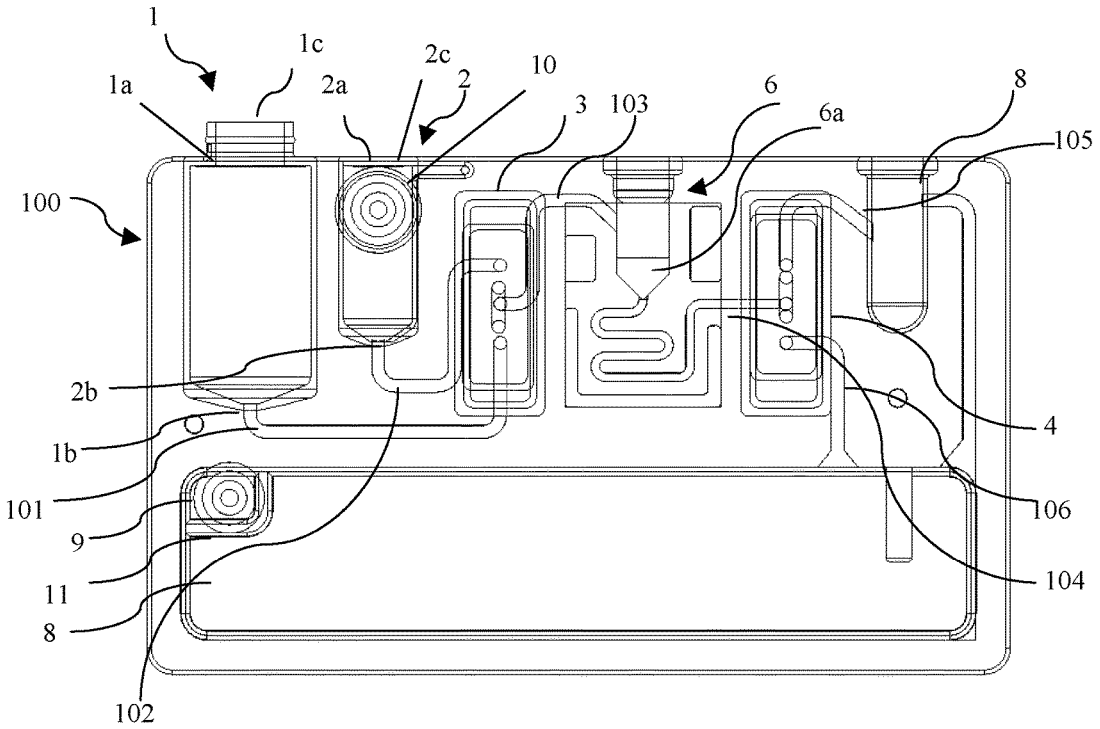
FIG. 1 shows schematic front view of cartridge according to an embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the scope of the disclosure as set forth in the appended claims. The novel features which are believed to be characteristic of the disclosure, as to its assembly, together with further objects and advantages will be better understood from the following description when considered in connection with the accompanying figures. It is to be expressly understood, however, that each of the figures is provided for the purpose of illustration and description only and is not intended as a definition of the limits of the present disclosure.

Embodiments of the present disclosure disclose a cartridge to be employed in a device for purifying biological samples. The cartridge is configured to purify multiple biological samples, thereby increases the applicability range of the purification device.

The present disclosure provides a cartridge for purifying biological samples. The cartridge comprises a first chamber configured to receive and hold biological samples to be purified. At least one second chamber is provisioned in the cartridge, to receive and hold a reagent solution. The first chamber, receives the biological samples through a suitable mechanism, and the at least one second chamber receives the reagent solution through a pump. Further, the outlet ports of the first chamber and the at least one second chamber are fluidly connected to a first fluid flow control valve. The first fluid flow control valve is fluidly connected to a matrix chamber for selectively routing biological samples and the reagent solution respectively, into the matrix chamber for capturing and purifying the nucleic acids. The term fluidly connected used herein above and below refers to a connection between the two fluid carrying units in the form of channel or passage which enables movement of fluid.

The matrix chamber is configured to be heated by an external heating source, and the heat is transferred to the matrix chamber. Further, a binding matrix is provided in the matrix chamber for capturing nucleic acids from the biological samples and the reagent solution in the matrix chamber. The binding matrix is adapted to capture nucleic acids from multiple biological samples, so that the purified nucleic acids from the biological samples are obtained. The purified nucleic acids are processed on a device for PCR analysis and detection.

Further, the matrix chamber is fluidly connected to a second fluid flow control valve. The second fluid flow control valve fluidly connects a elute collection chamber and a waste collection chamber. The elute collection chamber is configured to receive and hold purified nucleic acids from the biological samples for further processing. The waste collection chamber is configured to receive and hold waste fluids from the matrix chamber. An absorbent material is provided in the waste collection chamber for absorbing the waste fluids received from the matrix chamber, so that the waste fluids do not leak into the surroundings from the cartridge during and after use. The second fluid flow control valve selectively allows flow of purified nucleic acids and the waste fluids into the elute collection chamber and the waste collection chamber respectively. In an embodiment, the first fluid flow control valve and the second fluid flow control valve are three-way direction controlled valves.

The biological samples or mixture of biological samples and buffer solution is added to the first chamber. In the next step, the pump connected to the cartridge moves the reagent solution into the second chamber. The first fluid flow control valve is operated to allow the biological samples into the matrix chamber from the first chamber. Subsequently, the reagent solutions are allowed by the first fluid flow control valve into the matrix chamber from the at least one second chamber. The binding matrix binds or captures the nucleic acids in the biological samples and the reagent solution. Further, the matrix chamber receives heat from the external source for a predetermined duration of time to release nucleic acids bound to the binding matrix. The second fluid flow control valve is operated to allow the nucleic acids into the elute collection chamber. Subsequently, the second fluid flow control valve is operated to allow waste fluids to the waste collection chamber from the matrix chamber. The purified nucleic acid is processed into a device for PCR analysis and detection of organisms.

The terms "comprises", "comprising", or any other variations thereof used in the specification, are intended to cover a non-exclusive inclusion, such that a system comprises a list of components or steps does not include only those components or steps but may include other components or steps not expressly listed or inherent to such setup. In other words, one or more elements in a system or apparatus proceeded by "comprises . . . a" does not, without more constraints, preclude the existence of other elements or additional elements in the system or apparatus.

Henceforth, the present disclosure is explained with the help of one or more figures of exemplary embodiments. However, such exemplary embodiments should not be construed as limitations of the present disclosure.

Figure 2:
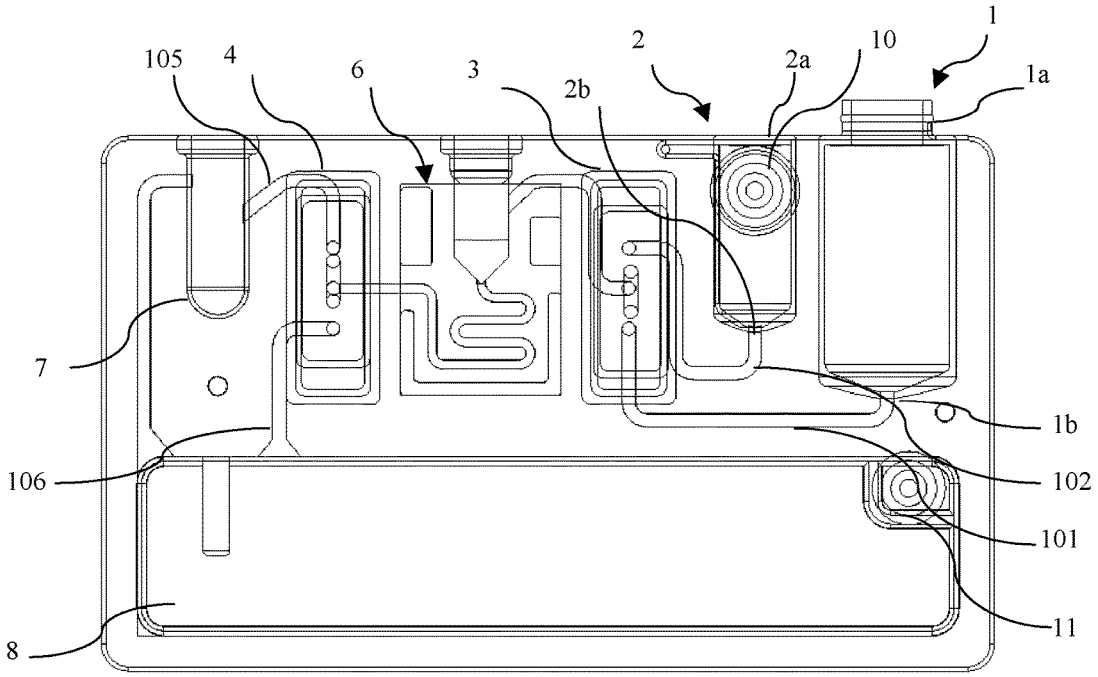
FIG. 2 illustrates rear view of the cartridge shown in FIG. 1.

FIGS. 1 and 2 illustrate front and rear view of the cartridge (100). The cartridge (100) is configured to purify multiple biological samples such as but not limiting to sputum, blood and serum. The term 'cartridge' indicated is referred to a three dimensional structure which is configured with predetermined width, length and height capable accommodating associated components for purifying the biological sample. In an embodiment, the cartridge is a disposable cartridge, and can be employed in a device for utilizing the purified biological sample obtained from the cartridge (100) for PCR analysis and detection. The device is configured with required sensors and control devices to operate the cartridge (100) to obtain purified biological sample. In an embodiment of the disclosure, the cartridge (100) is made of disposable material such as but not limiting to polycarbonate or acrylic material or cyclic olefin copolymers or other plastics which can withstand high temperature and is easily manufacturable.

As shown in FIGS. 1 and 2 the cartridge (100) comprises first chamber (1) having an inlet port (1*a*) and an outlet port (1*b*), configured to receive and hold biological samples to be purified. The first chamber (1) is configured with a predetermined shape and volume, for receiving adequate quantity of biological samples. In an embodiment, the first chamber (1) can be configured in shapes such as but not limiting to cylindrical, rectangular and square or any other geometrical shape, which serves the purpose of receiving and collecting the biological samples of adequate quantity. The term 'adequate quantity' indicated is the volume of the biological samples required for obtaining the adequate volume of purified biological sample, which suffices the need for further PCR processing, analysis and detection. The volume of the biological samples added to the first chamber (1) is in the range of 0.1 ml to about 3 ml. In an embodiment, a dilution buffer along with the biological samples can be inlet into the first chamber (1) based on the organism to be purified. The first chamber (1) is positioned at one extreme end of the cartridge (100) [shown in FIGS. 1 and 2]. In one embodiment, the first chamber (1) can be positioned anywhere in the cartridge (100), which serves the purpose of receiving and holding the biological samples. The first chamber (1) is further configured with a non-sticking inner surface, so that contents of the first chamber (1) can be drained completely. In an embodiment, the first chamber (1) is also configured with a lid (1*c*) which acts as a closure for the inlet port (1*a*), so that entry of dust, water vapor or other environmental elements is restricted.

The cartridge (100) also comprises at least one second chamber (2) having an inlet port (2*a*) and an outlet port (2*b*), configured to receive and hold reagent solution. The at least one second chamber (2) receives reagent solution based on the protocol used for purification. In an embodiment, the at least one second chamber (2) is configured in cylindrical, rectangular, square or other geometric shapes, which serves the purpose of receiving and holding the reagent solution of adequate quantity. In an exemplary embodiment, the volume of the second chamber (2) is 0.8 ml. Further, the at least one second chamber (2) can be positioned anywhere in the R (100), which serves the purpose of receiving and holding the reagent solution. In an embodiment, the at least one second chamber (2) is positioned adjacent to the first chamber (1). The at least one second chamber (2) is also configured with a non-sticking inner surface, so that the at least one second chamber (2) can be drained completely. In an embodiment, the at least one second chamber (2) is configured with a lid (2*c*) which acts as a closure for the inlet port (2*a*), so that entry of dust, water vapor or other environmental elements is restricted.

The biological sample from a subject is taken and inlet through the inlet port (1*a*) of the first chamber (1). In an embodiment, the subject is selected from group such as but not limiting to human and animals. The inlet port (2*a*) of the at least one second chamber (2) is fluidly connected to a pump [not shown in the Figures]. The pump routes the reagent solution into the at least one second chamber (2). In an embodiment, the pump routes the reagent solution present in the device in which the cartridge (100) is inserted. In an embodiment, the pump is selected from group such as but not limited to syringe pump, peristaltic pumps or other positive displacement pumps which serves the purpose of driving the biological samples and the reagent samples. The pump maintains a differential fluid pressure in the cartridge (100), to enable flow of biological samples and the reagent solution.

The outlet ports (1*b* and 2*b*) of the first chamber (1) and the at least one second chamber (2) are fluidly connected to a first fluid flow control valve (3), by channels (101 and 102). The first fluid flow control valve (3) also fluidly links a matrix chamber (6), via channel (103). The first fluid flow control valve (3) is configured to selectively route the biological samples and the reagent solutions into the matrix chamber (6) for capturing and purifying the nucleic acids in the biological samples and the reagent solutions. The first fluid flow control valve (3) is configured in between the second chamber (2) and the matrix chamber (6). In an embodiment, the first fluid flow control valve (3) can be positioned anywhere in the cartridge (100), which serves the purpose of fluidly connecting the first chamber (1) and second chamber (2) to the matrix chamber (6). In an embodiment, the first fluid flow control valve (3) is a three way sliding direction control valves operable between a first position and second position. In an embodiment, the first flow control valve (3) is a three-way, two position direction control valve. In an embodiment, the first fluid flow control valve (3) is selected from group such as but not limiting to solenoid valves and mechanical valves. As an example, the three way sliding direction control valve will have a member in the form of plate operable between the first position and the second position by linear actuators or motor. The linear actuator is selected from group such as but not limiting to rack and pinion mechanism, piston-cylinder devices operated by pneumatic and/or hydraulic power source. The member is configured to block/close one of the passage/channel of the two passage/channel of the valve, when the valve is operated between the first and second position to control the direction of flow of fluid into the matrix chamber of the cartridge (100). In another embodiment, the first fluid flow control valve (3) is a three way rotary valve, operated by a motor [not shown in figure] placed external to the cartridge (100). As an example, the three way rotary valve will have a member in the form of plate operable between the first position and a second position by a motor. In an embodiment, the motor is selected from group such as but not limiting to electric, hydraulic and pneumatic motors. The member is configured to block/close the respective passage/channel when operated between the first and second position to control the direction of flow of fluid in the cartridge (100). The first fluid flow control valve (3) when operated to first position, links the channels (101 and 103) to route biological samples into the matrix chamber (6). The first fluid flow control valve (3) when operated to second position, links the channels (102 and 103) to route reagent solution into the matrix chamber (6).

The matrix chamber (6) in the cartridge (100) may be disposed in contact with an external heating source [not shown in figures], when the cartridge (100) is inserted into the device. In an embodiment, the heat added to the matrix chamber is in the range of 90 degrees to 95 degrees for a period of 5 minutes.

Figure 4:
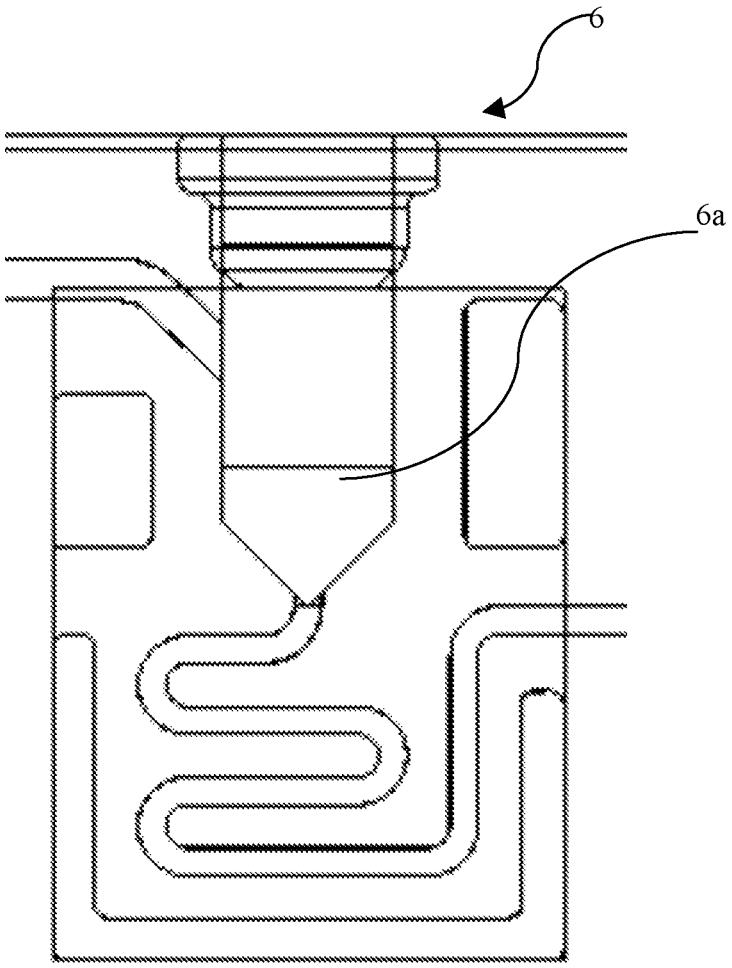
FIG. 4 illustrates magnified view of matrix chamber configured in the cartridge shown in FIG. 1.
Figure 5:
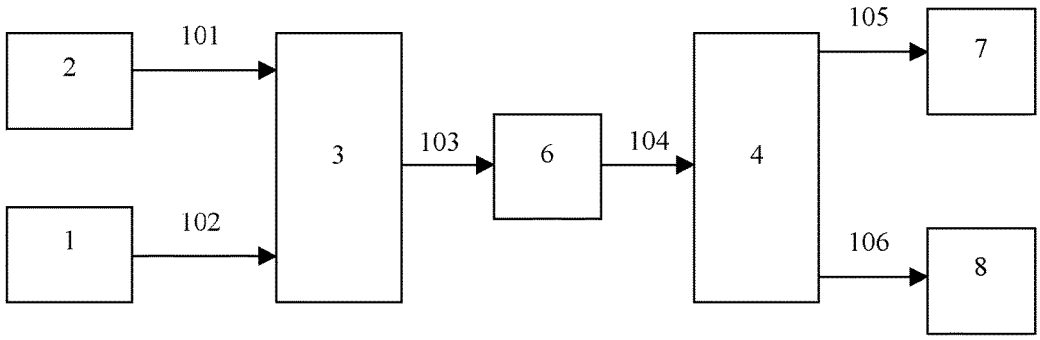
FIG. 5 illustrates a process flow diagram for purifying the biological sample by the cartridge.

The matrix chamber (6) [shown in FIG. 4] comprises a binding matrix (6*a*), which is configured to capture organisms and/or nucleic acids from the biological samples and the reagent solutions. In an exemplary embodiment, the binding matrix (6*a*) is configured with a mesh type structure for trapping the nucleic acids on its surface. In an embodiment, the binding matrix (6*a*) is selected from group such as but not limiting to natural cotton, surgical cotton, clinical grade cotton, commercial cotton, spun cotton, water washed cotton, acid or base washed cotton, autoclaved cotton, buffer treated cotton having pH ranging from about 1 to about 14, salt solution treated cotton, organic solvent treated cotton, pressed cotton and processed cotton. In the suspension solution, the components that are to be filtered from the mixture of biological samples and reagent solution have affinity towards the surface of the cotton matrix (6*a*). Thus, the organisms and/or nucleic acids in the suspension solution are collected or trapped on the binding matrix (6*a*). The remaining fluid in the suspension solution gets seeped through the binding matrix (6*a*), due to lack of affinity. In an embodiment, the binding matrix (6*a*) is washed by passing a buffer solution, to remove impurities from biological sample collected on the surface of the binding matrix (6*a*). Subsequent to purification the nucleic acids captured/bound from the biological samples and the reagent solutions are released by applying heat to the binding matrix (6*a*). The released nucleic acids are collected into the elute collection chamber (7). The collected purified nucleic acids are later processed for PCR analysis and detection.

Further, the matrix chamber (6) is fluidly connected to a second fluid flow control valve (4) via channel (104). The second fluid flow control valve (4) also fluidly connects a elute collection chamber (7) and a waste collection chamber (8) via channels (105 and 106). The second fluid flow control valve (4) is configured to selectively route the purified nucleic acids and waste fluid (rest of the mixture of biological samples and the reagent solution) into the elute collection chamber (7) and the waste collection chamber (8) respectively. The second fluid flow control valve (4) is configured in between the matrix chamber (6) and the elute collection chamber (7). In an embodiment, the second fluid flow control valve (4) can be positioned anywhere in the cartridge (100), which serves the purpose of fluidly connecting the matrix chamber (1) to the elute collection chamber (7) and the waste collection chamber (6). In an embodiment, the second fluid flow control valve (4) is a three way sliding direction control valve operable between a first position and a second position. In an embodiment, the second flow control valve (4) is a three-way, two position direction control valve. In an embodiment, the second fluid flow control valve (4) is selected from group such as but not limiting to solenoid valves and mechanical valves. As an example, the three way sliding direction control valve will have a member in the form of a plate, operable between the first position and the second position by linear actuators or motor. The linear actuator is selected from group such as but not limiting to rack and pinion mechanism, piston-cylinder devices operated by pneumatic and/or hydraulic power source. The member is configured to block/close the respective passage/channel of the two passages/channels, when the valve is operated between the first and second position to control the direction of flow of fluid in the cartridge (100). In another embodiment, the second fluid flow control valve (4) is a three way rotary valve, operated by a motor [not shown in figure] placed external to the cartridge (100), between a first position and a second position. As an example, the three way rotary valve will have a member in the form of a plate, operable between the first position and a second position by a motor. In an embodiment, the motor is selected from group such as but not limiting to electric, hydraulic and pneumatic motors. The member is configured to block/close the respective passage/channel when operated between the first and second position to control the direction of flow of fluid in the cartridge (100). The second fluid control valve (4) when operated to first position, links the channels (104 and 105) to route purified biological sample into the elute collection chamber (7) from the matrix chamber (6). The second fluid flow control valve (4) when operated to second position, links the channels (104 and 106) to route waste fluids into the waste collection chamber (6) from the matrix chamber (6).

The waste collection chamber (6) includes an absorbent material for absorbing the waste fluids received from the matrix chamber (6) via the channel (106). In an embodiment, the absorbent material is selected from group such as but not limiting to sponge. Absorption of waste fluids will enable to prevent spillage of waste fluids to the surroundings during and after purification of biological samples. This makes the use of cartridge (100) eco-friendly, hygienic and bio-safe for usage and disposal.

Figure 3:
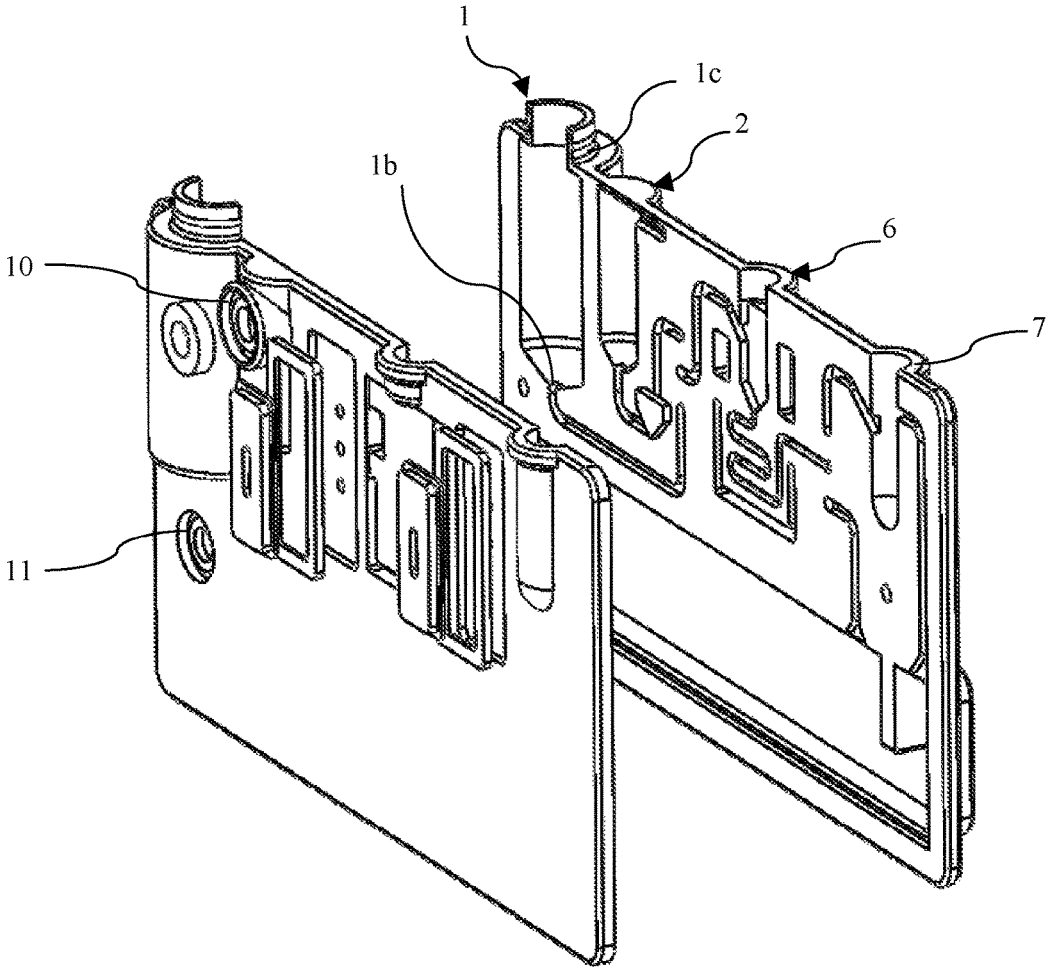
FIG. 3 illustrates exploded view of the cartridge shown in FIG. 1.

In an exemplary embodiment of the present disclosure, the cartridge (100) is two piece construction [as shown in FIG. 3]. Each piece of the cartridge (100) is configured such that upon joining, the cartridge (100) is capable of accommodating and purifying the biological sample. The individual pieces of the cartridge (100) are joined by methods such as but not limiting to adhesive bonding. In an embodiment, the cartridge (100) is a three piece construction and is held together by means as described above. In another embodiment, the components [i.e. first chamber (1), second chamber (2), matrix chamber (6), first fluid flow control valve (3), second fluid flow control valve (4), elute collection chamber (7) and waste collection chamber (8)] of the cartridge (100) are assembled such that dimensions of the cartridge (100) required is minimum, thereby making the cartridge (100) compact and portable. In an embodiment, the cartridge (100) is configured with provisions (10 and 11) for docking pumps required for pumping reagent solutions into the at least one second chamber (2). The pumps also maintain a differential fluid pressure in the cartridge (100) to enable flow of biological samples and the reagent solutions.

FIG. 6 illustrates a process flow diagram for purifying the biological samples by the cartridge (100). In the first step, the pump routes the biological samples and the reagent solution of predetermined quantities into the first channel (1) and the at least one second channel (2), respectively. In the second step, the first fluid flow control valve (3) is operated to a first position, to link channels (101 and 103) for routing biological samples into the matrix chamber (6) from the first chamber (1). Subsequently, the first fluid control valve (3) is operated to second position, to link channels (102 and 103) to route reagent solution into the matrix chamber (6) from the at least one second chamber (2).

In the next step, the organisms and/or nucleic acids in the biological samples and the reagent solutions are captured/bound by the binding matrix (6*a*). The organisms and/or nucleic acids captured by the binding matrix (6*a*) are based on the chemical conditions provided by the biological samples and the reagent solutions. At this stage, a buffer solution is passed to the matrix chamber (6) via the at least one second chamber (2) to wash the captured organisms from impurities. This also enables to allow flow of waste fluids from the matrix chamber (6).

In the next step, the matrix chamber (6) is heated by an external heating source for a predetermined duration of time. Heating the matrix chamber (6) will separate the captured or bound nucleic acids from the surface of the binding matrix (6*a*).

In the subsequent step, the second fluid flow control valve (4) is operated to a first position to link channels (104 and 105) for routing the purified nucleic acids from the biological sample and the reagent solution to the elute collection chamber (7). The purified nucleic acids are processed further for PCR analysis and detection. Lastly, the second fluid flow control valve (4) is operated to a second position to link channels (104 and 106) for routing the waste fluids to the waste collection chamber (8) from the matrix chamber (6). Thus, the biological samples are purified for PCR analysis and detection.

ADVANTAGES

The present disclosure provides a cartridge, which can purify multiple biological samples for PCR analysis and detection.

The present disclosure provides a cartridge, which contains waste fluids, thereby rendering the disposal bio-safe.

The present disclosure provides a cartridge, which is portable.

REFERRAL NUMERALS

| | |
|---|---|
| 100 | Cartridge |
| 101-106 | Fluid lines or channels |
| 1 | First Chamber |
| 1a | Inlet port of first chamber |
| 1b | Outlet port of first chamber |
| 1c | Lid for the first chamber |
| 2 | Second Chamber |
| 2a | Inlet port of second chamber |
| 2b | Outlet port of second chamber |
| 2c | Lid for the second chamber |
| 3 | First fluid flow control valve |
| 4 | Second fluid flow control valve |
| 6 | Matrix chamber |
| 6a | Binding matrix |
| 7 | Elute collection chamber |
| 8 | Waste collection chamber |
| 10, 11 | Provisions for docking pump |

We claim:

1. A cartridge for purifying biological samples, the cartridge comprising:

a first chamber configured to receive and hold biological samples;

at least one second chamber configured to receive and hold a reagent solution;

a first fluid flow control valve integrated within the cartridge, the first fluid flow control valve is fluidly connected to outlet ports of the first chamber, the at least one second chamber, and to an inlet port of a matrix chamber, wherein the first fluid flow control valve is positioned downstream of the first chamber and the at least one second chamber and upstream of the matrix chamber and establishes a fluid connection with the matrix chamber, wherein the first fluid flow control valve is configured to selectively route biological samples from the first chamber and reagent solution from the at least one second chamber into the matrix chamber for purifying the biological samples;

a cotton binding matrix provided in the matrix chamber for capturing nucleic acids from the biological samples; and a second fluid flow control valve integrated within the cartridge, the second fluid flow control valve is positioned downstream of the matrix chamber and upstream of an eluent collection chamber, wherein the second fluid flow control valve is configured to route purified nucleic acids from the matrix chamber to the eluent collection chamber.

2. The cartridge as claimed in claim 1, wherein the biological samples are routed into the matrix chamber as a first step.

3. The cartridge as claimed in claim 1, wherein the reagent solution is routed into the matrix chamber after routing the biological samples.

4. The cartridge as claimed in claim 1 comprises a waste collection chamber fluidly connected to the matrix chamber to receive waste fluids from the matrix chamber.

5. The cartridge as claimed in claim 4, wherein the waste collection chamber includes an absorbent material to absorb the waste fluids received from the matrix chamber.

6. The cartridge as claimed in claim 1, wherein the second fluid flow control valve selectively connects the matrix chamber to a waste collection chamber.

7. The cartridge as claimed in claim 6, wherein the second fluid flow control valve is configured to route waste fluids from the matrix chamber into the waste collection chamber.

8. The cartridge as claimed in claim 1, wherein the at least one second chamber receives the reagent solution through a pump.

9. The cartridge as claimed in claim 1, wherein the matrix chamber is heated by an external heating source to separate the nucleic acids captured on the cotton binding matrix.

10. The cartridge as claimed in claim 1, wherein the first fluid flow control valve and the second fluid flow control valve are three-way directional control valves.

11. A device for purifying biological samples comprising a cartridge as claimed in claim 1.

12. The cartridge as claimed in claim 1, wherein the cotton binding matrix is configured to trap nucleic acids from the biological samples on a surface of the cotton binding matrix.

* * * * *